US007431635B2

(12) United States Patent
Dong et al.

(10) Patent No.: US 7,431,635 B2
(45) Date of Patent: Oct. 7, 2008

(54) INTERNAL GEAR GRINDING METHOD

(75) Inventors: Xingen Dong, Greeneville, TN (US); Barun Acharya, Johnson City, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 190 days.

(21) Appl. No.: 11/412,760

(22) Filed: Apr. 27, 2006

(65) Prior Publication Data

US 2006/0242834 A1 Nov. 2, 2006

Related U.S. Application Data

(60) Provisional application No. 60/676,459, filed on Apr. 29, 2005.

(51) Int. Cl.
*B24B 1/00* (2006.01)

(52) U.S. Cl. ..... 451/51; 451/61

(58) Field of Classification Search ..... 29/893.35, 29/893.3; 451/51, 52, 59, 61; 82/1.2, 1.3, 82/1.4

See application file for complete search history.

(56) References Cited

U.S. PATENT DOCUMENTS 1,798,059 A 3/1931 Bilgram et al.
2,665,612 A 1/1954 Nubling
3,774,346 A * 11/1973 Hoglund ..... 451/211
3,782,040 A 1/1974 Harle et al.
3,894,255 A * 7/1975 Newton, Jr. ..... 310/80
4,052,928 A * 10/1977 Pierrat et al. ..... 409/38
4,058,938 A 11/1977 Harle et al.
4,533,302 A * 8/1985 Begley ..... 418/61.3
4,586,885 A * 5/1986 Middlekauff ..... 418/61.3

* cited by examiner

*Primary Examiner*—Timothy V Eley
(74) *Attorney, Agent, or Firm*—Robert J. Clark; Daniel J. Whitman; Joseph J. Pophal

(57) ABSTRACT

In a method for successively generating, on the inner peripheral surface of a ring, the individual profiles of a plurality of teeth of an internally toothed gear wheel: positioning the ring on a turntable; imparting complex motions, at a predetermined speed relationship therebetween, on the turntable; rotating a contoured grinding wheel, via both axial and radial feeding motions, as the grinding wheel enters into the inside of the ring for the tooth profile generation; keeping the tip radius of the grinding wheel at least substantially similar to the radius of the arc shape of each tooth; and continuously maintaining but a single contact line, between the grinding wheel and the ring inner peripheral surface, during the actual generation of the tooth profiles on the inner peripheral surface of the ring, with the complex motions including both, at least partially concurrent, angular and orbital movements, in the same angular direction.

25 Claims, 5 Drawing Sheets

INNER GEAR ROTATION ANGLE/ ORBITING ANGLE 0°/0°(CCW/CW)

INNER GEAR ROTATION ANGLE/ ORBITING ANGLE 9°/81°(CCW/CW)

INNER GEAR ROTATION ANGLE/ ORBITING ANGLE 18°/162°(CCW/CW)

INNER GEAR ROTATION ANGLE/ ORBITING ANGLE 27°/243°(CCW/CW)

INNER GEAR ROTATION ANGLE/ ORBITING ANGLE 36°/324°(CCW/CW)

OUTER GEAR ROTATION ANGLE/ ORBITING ANGLE 0°/0°(CW/CW)

OUTER GEAR ROTATION ANGLE/ ORBITING ANGLE 8°/80°(CW/CW)

OUTER GEAR ROTATION ANGLE/ ORBITING ANGLE 16°/160°(CW/CW)

OUTER GEAR ROTATION ANGLE/ ORBITING ANGLE 24°/240°(CW/CW)

OUTER GEAR ROTATION ANGLE/ ORBITING ANGLE 32°/320°(CW/CW)

OUTER GEAR ROTATION ANGLE/ ORBITING ANGLE 0°/0°(CW/CW)

OUTER GEAR ROTATION ANGLE/ ORBITING ANGLE 8°/80°(CW/CW)

OUTER GEAR ROTATION ANGLE/ ORBITING ANGLE 16°/160°(CW/CW)

OUTER GEAR ROTATION ANGLE/ ORBITING ANGLE 24°/240°(CW/CW)

OUTER GEAR ROTATION ANGLE/ ORBITING ANGLE 32°/320°(CW/CW)

INTERNAL GEAR GRINDING METHOD

CROSS-REFERENCE TO RELATED CASES

The present application claims the benefit of the filing date of U.S. Provisional Application Ser. No. 60/676,459, filed Apr. 29, 2005, the disclosure of which is incorporated herein by reference.

FIELD OF THE INVENTION

The present invention pertains to the generation, on the inner peripheral surface of a ring, the inner profiles of a plurality of teeth of an internally toothed gear wheel that finds utility, for example, as an internally toothed outer ring of an internally generated gerotor hydraulic mechanism. More particularly, the invention pertains to an improved grinding method that produces such internally toothed gear wheels having high accuracy while being produced by low cutting forces while being subjected to negligible machine deformation.

BACKGROUND OF THE INVENTION

The gerotor is a special positive displacement mechanism that is capable of delivering a known, predetermined, quantity of fluid in proportion to its revolving speed. A gerotor set can also be considered as a special form of an internal gear transmission mechanism, consisting of two main elements: (I) an externally toothed inner rotor or gear; and (II) an internally toothed outer ring or gear, as best seen in both FIGS. 1A and 1B. The inner rotor of any gerotor set has one less tooth than its adjoining outer ring, and the inner rotor and the outer ring possess different centers with a fixed eccentricity. When both the inner rotor and the outer ring are free to rotate with their fixed centers, the rotation of the inner rotor will force the outer ring to rotate in the same direction. However, when the outer ring is fixed, rotation of the inner rotor will cause the center of the inner rotor to orbit in the opposite direction, with this motion being similar to that of a planetary gear revolving around the inside of a ring gear. Therefore, depending on how a gerotor set is used at a specific actual application, the gerotor set can be either non-orbital or orbital. Non-orbital gerotor sets, for example, are commonly used in high speed gerotor pumps, while orbital gerotor sets, for example, are typically used for low speed gerotor motors.

In addition, a gerotor set can be classified as an externally generated rotor (EGR) set (FIG. 1A) or an internally generated rotor (IGR) set (FIG. 1B). The inner rotor "teeth" of an EGR gerotor set are specially shaped lobes that are in contact with circular arcs/rollers of the outer ring at all times when the inner rotor revolves. Vise versa, the outer ring "teeth" of an IGR gerotor set are specially shaped lobes that are in contact with the noted circular arcs/rollers of the adjoining inner rotor at all times when the inner rotor revolves. Each volume chamber of any gerotor set is separated by continuous contact between the lobes and circular arcs/rollers, with the volume of each chamber changing as the inner rotor revolves. The rotary mechanism of the gerotor set, by virtue of its continuous chamber volume change, can be used as a positive displacement fluid controller in mechanisms such as hydraulic pumps, motors, steering units and rotary engines, etc. Gerotor mechanisms are currently recognized as the most popular working power elements for hydraulic pumps and motors. It is estimated that more than 50 million gerotor pumps and more than 2 million gerotor motors are manufactured yearly, worldwide, because gerotors provide a good combination of compact size and low manufacturing cost, with these noted quantities being much greater than those of any other type of hydraulic pump and motor.

Much effort has been expended to perfect this internal gear mechanism with continuous contact between the inner rotor and the outer ring while using an internal gear set of one-tooth difference. Initially, manufacturers had claimed that it was not practical to tool the gerotor for mass production and it was not until the 1920's that Henry Nichols developed a special profile gear grinder for the inner rotor of the EGR gerotor, with several later generation grinders of this type currently still being in service, albeit, mainly for low-volume special applications.

Both EGR and IGR gerotor sets require high precision manufacturing tools and methods along with very tight dimensional tolerances, particularly on the rotor profile. Currently, two methods are used to machine the external surface of the inner rotor of an EGR gerotor set. The external special profile of an EGR inner rotor can either be ground by a special gerotor grinding machine of the type invented by Henry Nichols or by a multi-purpose profile/form grinder. The inventors of the present invention are unaware of any special grinder that has been developed for grinding the special profile of the inner surface of the IGR outer ring. The only known mass production method currently being used utilizes a very expensive multi-purpose profile/form grinder. FIGS. 2A and 2B, which will be discussed in more detail later, illustrate the current grinding method for generating the internal surface of an IGR outer ring that utilizes a specially profiled grinding wheel installed within a cantilevered column. Due to possible deformation of the noted cantilevered column, during the grinding operation, an IGR rotor, ground via the previously noted internal profile/form grinder, may possibly have mismatch problems near the area where two gear flanks meet as shown in FIGS. 3A, 3B and 3C which will also be discussed in more detail hereinafter.

The patent literature lists a number of apparatuses and methods for grinding the tooth flanks on internally toothed gear wheels that include: U.S. Pat. No. 1,798,059 to Bilgram et al.; U.S. Pat. No. 2,665,612 to Nübling; as well as U.S. Pat. Nos. 3,782,040 and 4,058,938, both to Härle et al. However, none of the prior art methods of gear generation, set forth therein, pertain to the methods set forth in the present invention.

SUMMARY OF THE INVENTION

Accordingly, in order to overcome the deficiencies of the prior art devices and methods, the present invention provides an improved method for generating, on the inner peripheral surface of a ring, the individual profiles of a plurality of teeth of an internally toothed gear wheel that finds specific use as an internally toothed outer ring in an IGR gerotor set which also includes an inner rotor having a plurality of external teeth adapted to mesh, in a known manner, with the noted outer ring internal teeth.

Specifically, one embodiment of this invention pertains to a method for grinding the inner peripheral surface of a ring for the successive generation of the individual profile of each tooth of an internally toothed gear wheel, the method including the steps of: a) precisely positioning the ring on a turntable; b) imposing complex motions, at a predetermined speed relationship between the motions, on the turntable; c) actuating a rotatable, contoured, grinding wheel, via both axial and radial feeding motions as the grinding wheel enters into the inside of the ring, for the generation of the individual profile of each of the teeth; d) keeping the tip radius of the contoured grinding wheel at least substantially similar to the radius of the arc shape of the teeth; and e) continuously maintaining but a single contact line, during the actual generation of the internally toothed gear wheel, between the contoured grinding wheel and the inner peripheral surface of the ring.

In one version thereof, the complex motions include both angular and orbital movements.

In another version thereof, the angular and orbital movements are in the same angular direction.

In a differing version, the angular and orbital movements are at least partially concurrent and are in the same angular direction.

In a further version, the axial and radial feeding motions of the contoured grinding wheel are at least partially concurrent.

In yet another version, the tip radius of the grinding wheel is substantially identical to the radius of the arc shape of the teeth.

In a still differing version, the generation of the individual profile of each tooth is successive and extends around the entire inner peripheral surface of the ring.

In a still different version thereof, the toothed gear wheel takes the form of an internally toothed outer ring of an IGR set that also includes an inner rotor having a plurality of external teeth.

In variations of the above version, the predetermined speed relationship between the complex motions depends upon the relative number of teeth of the IGR inner rotor and the outer ring; the complex motions include both angular and orbital rotations; the angular and orbital rotations are in the same angular direction; and the angular and orbital rotations are at least partially concurrent.

In another variation, the axial and radial feeding motions of the contoured grinding wheel are at least partially concurrent.

In a differing variation, the tip radius of the contoured grinding wheel is substantially identical to the radius of the arc shape of the teeth.

Another embodiment of this invention pertains to a method for grinding the inner peripheral surface of a ring for the successive generation of the individual profile of each tooth, of a plurality of teeth, of an internally, peripherally toothed outer ring gear of an internally generated gerotor set, the method including the steps of: a) securing the ring on a turntable; b) subjecting the turntable to both angular and orbital motions, in the same angular direction; c) rotating a contoured grinding wheel, via both axial and radial feeding motions, as the grinding wheel enters into the inside of the ring, for the generation of each of the tooth profiles; d) maintaining the tip radius of the contoured grinding wheel substantially the same as the radius of the arc shape of the teeth; and e) keeping a single contact line, between the contoured grinding wheel and the inner peripheral surface of the ring, during the actual generation of the internally toothed outer ring.

In one version thereof, the securing step of the ring further includes precisely positioning the ring.

In another version thereof, the step, subjecting the turntable to both angular and orbital motions, further includes that the motions are at least partly concurrent and preferably further includes a predetermined speed relationship between the angular and orbital motions.

In a differing variation, the step, rotating the contoured grinding wheel, further includes that the axial and radial feeding motions of the grinding wheel are at least partially concurrent.

In a further version, the internally generated gerotor set further includes an inner rotor having a plurality of external, peripheral teeth. In addition, the predetermined speed relationship between the angular and orbital motions is based upon the relative number of teeth of the inner rotor and the outer ring of the internally generated gerotor set.

A further embodiment of the present invention pertains to a method for generating, at the inner peripheral surface of a ring, the individual profile of each tooth, of a plurality of teeth, of an outer ring gear of an IGR gerotor set, the method comprising: a) precisely positioning and securing a flat side surface of the ring on a turntable; b) imparting both angular and orbital motions, in the same angular direction and at a predetermined speed relationship, to the turntable; c) rotating a contoured grinding wheel, for generating each the tooth profile, via both axial and radial feeding motions when the grinding wheel initially enters into the inside of the ring; d) sustaining the tip radius of the contoured grinding wheel to be substantially the same as the radius of the arc shape of each the tooth; and e) preserving a continuous line contact, between the contoured grinding wheel and the ring inner peripheral surface, for the actual generation of the teeth for the outer ring gear.

In one version thereof, the angular and orbital motions are fully concurrent.

In another version, the axial and radial feeding motions of the contoured grinding wheel are substantially concurrent.

The previously-described advantages and features, as well as other advantages and features will become readily apparent from the detailed description of the preferred embodiments that follow.

DETAILED DESCRIPTION OF THE INVENTION

Figure 1A:
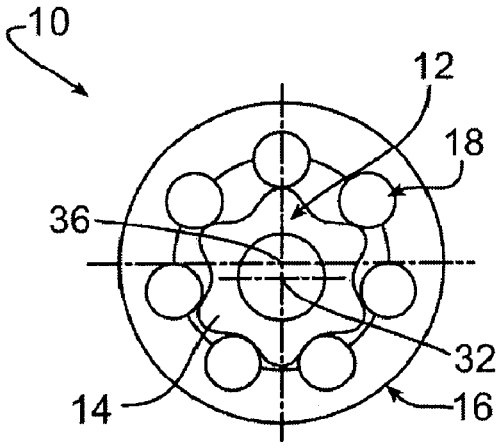
FIG. 1A PRIOR ART
FIG. 1A is a schematic representation of a known, prior art, externally generated rotor (EGR) gerotor set.

Referring now to the several drawings, illustrated in FIG. 1A is a schematic representation of a known prior art, externally generated (EGR) gerotor set, generally indicted at 10, basically including two elements, namely an inner rotor or gear 12 having a plurality of external teeth 14 and an outer ring or gear 16 having a plurality of internal teeth 18. As already noted, the number of external teeth 14 of inner rotor 12, of any gerotor set, is one less than the number of internal teeth 18 of outer ring 16. External teeth 14 of EGR inner rotor 12 take the form of specially shaped lobes that are in contact with the internal teeth 18 of EGR outer ring 16, with teeth 18 taking the form of circular arcs or rollers and being in contact with teeth 14 at all times when inner rotor 12 revolves.

Figure 1B:
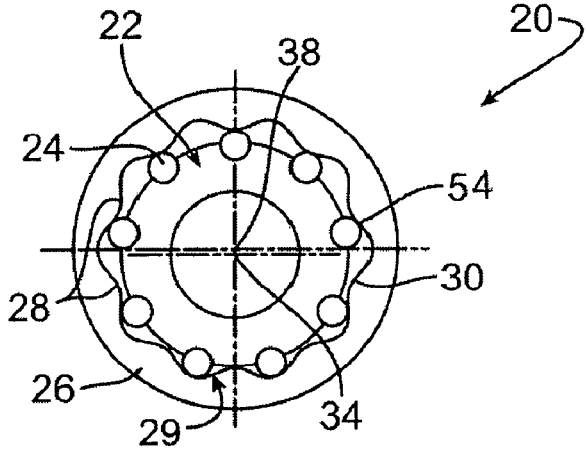
FIG. 1B PRIOR ART
FIG. 1B is a schematic representation of a known, prior art, internally generated rotor (IGR) gerotor set.

FIG. 1B is a schematic representation of a known prior art, internally generated (IGR) gerotor set, generally indicated at 20, basically again including two elements, namely an inner rotor or gear 22 having a plurality of external teeth 24, taking the shape of circular arcs or rollers, and an outer ring or gear 26 having a plurality of teeth 28, taking the form of specially shaped lobes, with teeth 24 and 28 being in contact at all times when inner rotor 22 revolves. As noted earlier, inner rotors 12 and 22 have respective inner centers or axes of revolution 32 and 34 that differ, with a fixed eccentricity, from respective centers or axes of revolution 36 and 38 of outer rings 16 and 26.

Figure 2A:
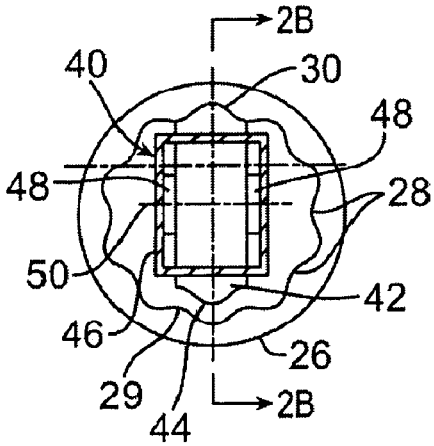
FIG. 2A PRIOR ART
FIG. 2A is an end view of a schematic representation illustrating a portion of a prior art profile grinder for grinding an IGR outer ring inner tooth surface portion.
Figure 2B:
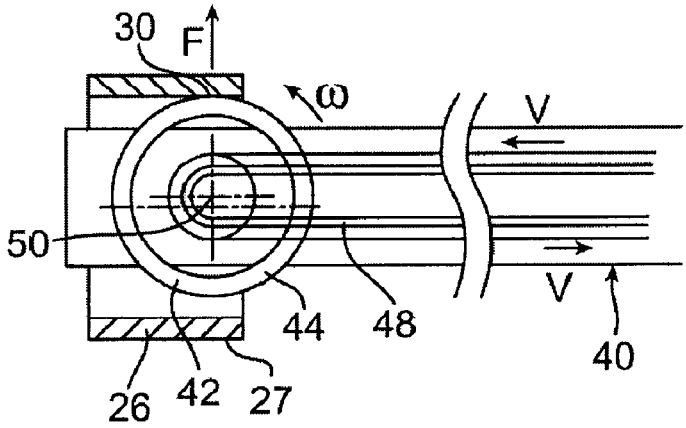
FIG. 2B PRIOR ART
FIG. 2B is a sectional view, taken along line 2B-2B of FIG. 2A.

FIGS. 2A and 2B are schematic representations of a small portion of a prior art conventional profile grinder 40, such as of the known Nichols type derivatives, used for generating each specific profile 30 of each internal tooth 28 of an IGR outer ring 26 which has an axial width or extent 27. As illustrated, a rotatable grinding wheel 42, having an outer or peripheral profile 44 substantially identical to a portion of tooth profile 30, is installed inside of a cantilever column 46, with grinding wheel 42 being rotated counterclockwise about axis 50, at high speed, by a pair of high velocity drive belts 48, at axially opposed sides of grinding wheel 42. As noted, the GD profile 44 of grinding wheel 42 is substantially identical to, equivalent to, or corresponds to, a portion of the inner tooth profile 30 of each inner tooth 28 of IGR outer ring 26 that must be generated. This is the reason why this type of grinding method is also denominated as form grinding and multi-purpose profile grinder 40 can grind or generate an inner surface 29 of JGR outer ring 26 with good precision and efficiency. The specific GD profile of grinding wheel 42 is very precisely dressed with CNC continuous control dresser. However, non-dressable grinding wheels are also available with a single layer outer surface of CBN crystals. Most of such grinding wheels have extraordinary accuracy and extremely long and consistent lives due to their great wear resistance. Such grinding wheels can also be sent to grinding wheel suppliers for "re-plating" once they wear excessively.

Figure 3A:
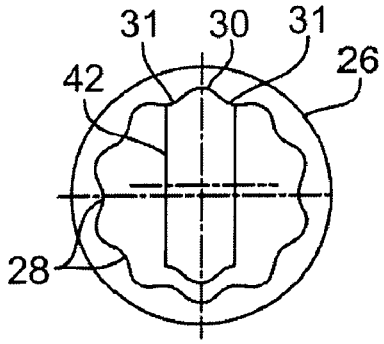
FIG. 3A PRIOR ART
FIG. 3A is a schematic representation, similar to that of FIG. 2A, again illustrating a prior art use of a profile/form grinding method for generating an IGR outer ring inner tooth surface portion.
Figure 3B:
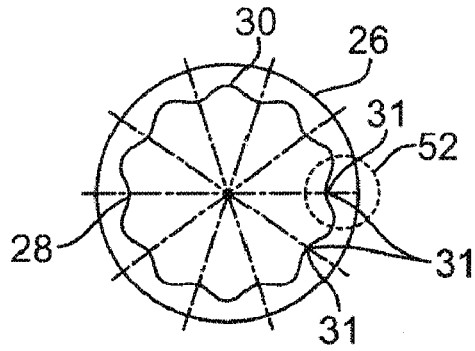
FIG. 3B PRIOR ART
FIG. 3B illustrates the prior art IGR outer ring inner tooth surface portions of FIG. 3A where two gear flanks meet.
Figure 3C:
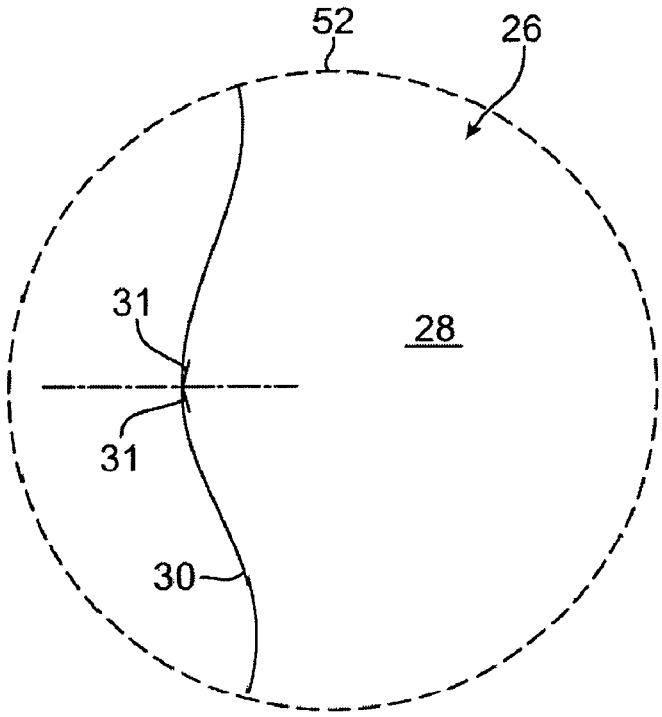
FIG. 3C PRIOR ART
FIG. 3C is an enlargement of the circled area of FIG. 3B, illustrating the tooth flank mismatch problem of the prior art.
Figure 4A:
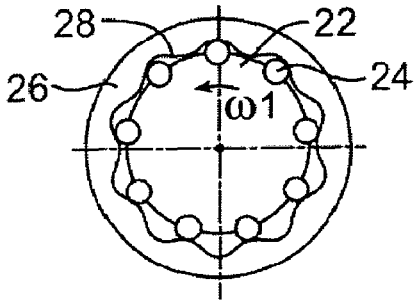
FIG. 4A PRIOR ART
FIGS. 4A-4E illustrate successive rotational and orbital displacements in a sample, prior art, IGR gerotor set, wherein an inner gear or rotor simultaneously rotates 9° counterclockwise (ccw) and orbits 81° clockwise (cw), between each of FIGS. 4A-4E, inside of a fixed outer gear or ring.
Figure 4B:
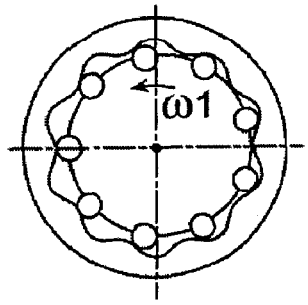
FIG. 4B PRIOR ART
Figure 4C:
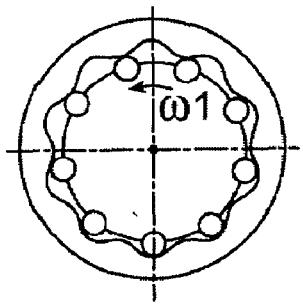
FIG. 4C PRIOR ART
Figure 4D:
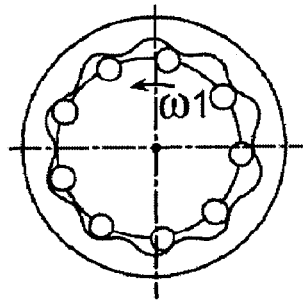
FIG. 4D PRIOR ART
Figure 4E:
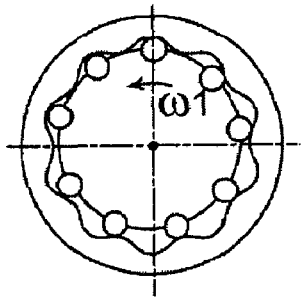
FIG. 4E PRIOR ART
Figure 5A:
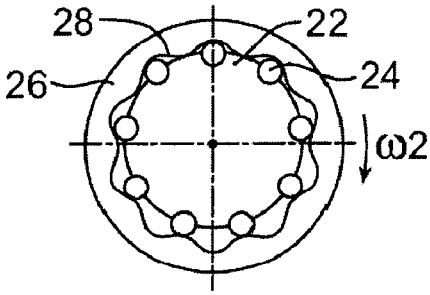
FIG. 5A PRIOR ART
FIGS. 5A-5E illustrate successive rotational and orbital displacements in a sample, prior art, IGR gerotor set, wherein an outer gear or ring simultaneously rotates 8° cw and orbits 80° cw, between each of FIGS. 5A-5E, around a fixed inner gear or rotor.
Figure 5B:
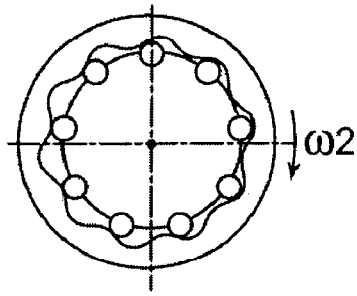
FIG. 5B PRIOR ART
Figure 5C:
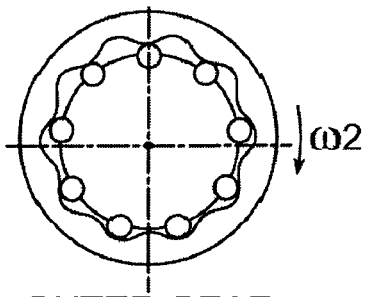
FIG. 5C PRIOR ART
Figure 5D:
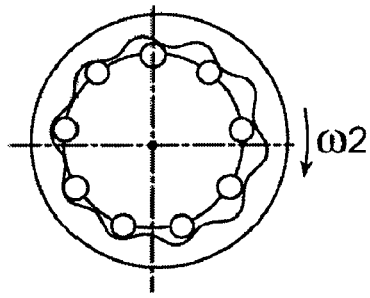
FIG. 5D PRIOR ART
Figure 5E:
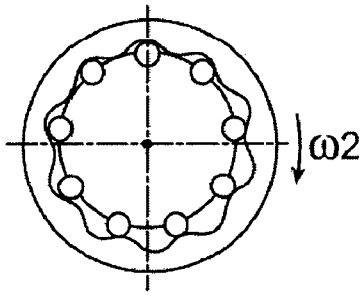
FIG. 5E PRIOR ART
Figure 6A:
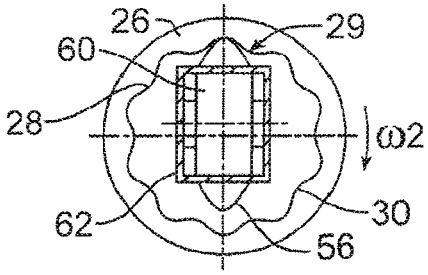
FIGS. 6A-6E illustrate successive rotational and orbital displacements, utilizing the grinding method of this invention, wherein an outer gear or ring, for use in a sample IGR gerotor, simultaneously rotates 8° cw and orbits 80° cw, between each of FIGS. 6A-6E, around a fixed inner, profiled and rotating, grinding wheel.
Figure 6B:
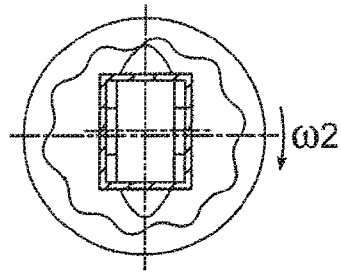
Figure 6C:
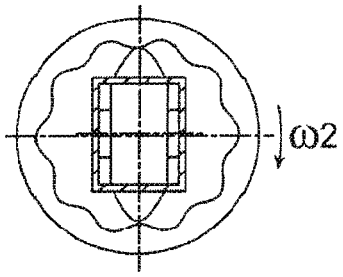
Figure 6D:
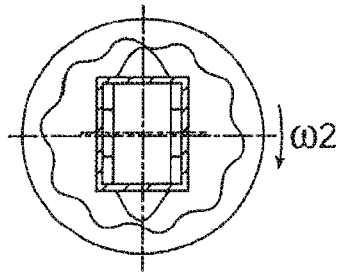
Figure 6E:
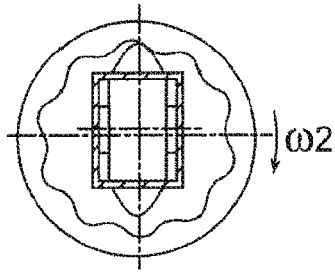

Turning now to FIG. 3A, it is a schematic representation, similar to that of FIG. 2A, again illustrating a prior art use of a profile/form grinding method for generating a portion of the profile 30 of a portion of an IGR outer ring internal tooth 28. Due to possible deformation of the grinder cantilever column 46 (FIG. 2A), during the grinding operation, an IGR outer ring inner profile 29, ground via the above-noted internal conventional profile grinder 40, may possibly have mismatch problems near the area where two gear tooth flanks 31 meet as seen in FIG. 3B but best illustrated in the enlargement of the circled portion 52, of FIG. 3B, in FIG. 3C. Furthermore, it should be noted that conventional profile/form grinders, of the type utilized in carrying out the described grinding process are very high in cost.

FIGS. 4A-4E illustrate the successive rotational and orbital displacements of previously described IGR gerotor set 20 (FIG. 1B) wherein inner rotor 22 simultaneously rotates 9° counterclockwise (ccw) and orbits 81° clockwise (cw), between each of FIGS. 4A-4E, inside of fixed outer ring 26. As noted, in the normal sequential operation of IGR gerotor set 20, outer ring 26 is fixed and inner rotor 22 both rotates and orbits inside of outer ring 26. The number of teeth 24 of inner rotor 22 is equal to Z1 and the number of teeth 28 of outer ring 26 is equal to Z2. When inner rotor 22 rotates inside fixed outer ring 26, there are a total of Z1 contact points between gears 22 and 26, with the locations of the contact points moving as inner rotor 22 revolves. In addition, to its angular rotation, inner rotor 22 also orbits, in the opposite rotational direction, with respect to its own axis of rotation, at a certain speed in a manner well known in the art. The relationship between the rotational and orbital speeds of inner rotor 22 depends, of course, upon the specific values of Z1 and Z2.

FIGS. 5A-5E illustrate the successive rotational and orbital displacements of previously described IGR gerotor set 20 (FIG. 2A), wherein outer ring 28 simultaneously rotates 8° cw and orbits 80° cw, between each of FIGS. 4A-4E, around fixed inner rotor 22. As noted, in the FIGS. 5A-5E gear movement, inner rotor 22 is fixed and outer ring 26 is free to move. As outer ring 26 rotates around fixed inner rotor 22, it also orbits in the same rotational direction. The relationship between the rotational and orbital speeds of outer ring 26 again depends on the specific values of Z1 and Z2. As outer ring 26 revolves, there are a total number of Z1 contact points between gears 22 and 26, with the locations of the contact points moving as outer ring 26 revolves.

Turning now to FIGS. 6A-6E, illustrated, in schematic form, are successive rotational and orbital displacements, utilizing the grinding method of the present invention, wherein an outer ring 26, of an IGR gerotor 20, simultaneously rotates 8' degrees cw and also orbits 80° cw, between each of FIGS. 6A-6E, around a fixed inner, profiled and rotating grinding wheel 60. While FIGS. 6A-6E are similar to those of FIGS. 5A-5E, a known, profiled, rotatable grinding wheel 60 is used to replace fixed inner rotor 22. The OD of profiled grinding wheel has a tip arc radius 56 that is substantially identical to the arc radius 54 of previously noted inner rotor teeth 24. Assuming, with outer ring 26 precisely positioned on a turntable (not illustrated) having both rotational and orbital motion capabilities in the same rotational direction as well as the same aforementioned speed relationship (as in FIGS. 5A-5E), grinding wheel 60 will remain in continuous contact with orbiting outer ring 26 as outer ring 26 concurrently rotates with the turntable, so that there is but one continuous contact line between grinding wheel 60 and inner surface 29 of outer ring 26 during the actual generation of tooth profiles 30. When grinding wheel 60 rotates at high speed and has a high feed speed (both in the axial and radial directions of outer ring 26), the tip arc 56 of grinding wheel 60 will cut or generate the full and complete inner profile 30 of each of inner teeth 28 of outer ring 26 that constitute the full inner surface 29 of outer ring 26. Specifically, during the time frame when neither radial nor axial feed forces are applied to the grinding wheel, during the grinding process, there is only point contact with the gear ring surface since the tip of the grinding wheel is in the shape of a radius while the inner surface of the gear ring has the shape of a special curve. However, upon the introduction of radial and/or axial feed forces, the point contact changes to a continuous small regional or line-type contact area due to the noted feed forces. In other words, when the grinding wheel is cutting gear ring material at the X-Y plane at Z cutting depth, it also removes this material at Z+ depth and in the X+/Y+ plane since there is material stock in each of the x-y-z directions.

The just described cutting/grinding method is based on the gear meshing/conjugation theorem and is in the form of continuous grinding thereby generating the desired inner profile 30 of each of IGR outer ring inner teeth 28 at a very high accuracy. It should be understood that grinding wheel 60 will still need to be dressed once it wears, however, the profile of the OD of grinding wheel 60 is but a simple arc and can be dressed readily with only a simple rotating dressing tool. In addition, the generated cutting or grinding force is quite low, considering a single of contact cutting between grinding wheel 60 and outer ring 26, with the deformation of a cantilever grinding column 62 thus being negligible. The cost of such a new grinder or grinding machine is very low in comparison to that of the previously discussed, known, multipurpose grinder 40. One possible disadvantage of this new grinding machine 60 and/or new grinding method may be the possibly lower efficiency of the actual cutting operation, i.e., it may require more time to generate the inner surface of the IGR outer rotor in comparison to using a multi-purpose profile/form grinder. However, the higher accuracy, low cutting forces and negligible machine deformation are important advantages.

The following are deemed to be special features and/or method steps of the new grinding method for the generation of the internal tooth surfaces of an IGR outer ring:

1. Continuously cutting the entire inner surface of an IGR outer ring, in the circumferential direction, using a rotating grinding wheel.
2. Utilizing complex motions of the turntable upon which the outer ring is precisely positioned, with such motions including concurrent angular and orbital rotations or motions, occurring in the same angular direction at a predetermined speed relationship, depending upon the relative number of teeth of the IGR inner rotor and outer ring and maintaining but a single continuous contact line during the generation of the outer ring inner surface, between the grinding wheel and the outer ring inner surface.
3. Keeping the tip radius of the grinding wheel theoretically identical or at least substantially similar to the radius of the arc shape of each of the noted outer teeth of the IGR rotor. However, the actual tooth radii of the inner teeth of the IGR outer ring could be subjected to small tolerance adjustments due to the consideration of a possibly desirable rotor tip clearance as well as any possible thermal expansion of the outer ring occurring during the tooth and/or other fabrication processes.
4. Actuating the grinding wheel in both axial and radial feeding movements when same enters inside the IGR outer ring to perform the required generation of the inner surface, i.e., the grinding of the inner teeth profiles for their entire axial extents.

It is deemed that one of ordinary skill in the art will readily recognize that the present invention fills remaining needs in this art and will be able to affect various changes, substitutions and various other aspects of the invention as described herein. Thus, it is intended that the protection granted hereon be limited only by the scope of the appended claims and their equivalent.

What is claimed is:

1. A method for grinding the inner peripheral surface of a ring for the successive generation of the individual profile of each tooth of an internally toothed gear wheel, said method including the steps of:

a. precisely positioning said ring on a turntable;

b. imposing complex motions, at a predetermined speed relationship between said motions, on said turntable;

c. actuating a rotatable, contoured, grinding wheel, via both axial and radial feeding motions as said grinding wheel enters into the inside of said ring, for said generation of said individual profile of each of said teeth;

d. keeping a tip radius of said contoured grinding wheel at least substantially similar to a radius of an arc shape of said teeth; and e. continuously maintaining but a single contact line, during the actual generation of said internally toothed gear wheel, between said contoured grinding wheel and said inner peripheral surface of said ring.

2. The method for grinding of claim 1, wherein said complex motions include both angular and orbital movements.

3. The method for grinding of claim 2, wherein said angular and orbital movements are in the same angular direction.

4. The method for grinding of claim 2, wherein said angular and orbital movements are at least partially concurrent.

5. The method for grinding of claim 4, wherein said angular and orbital movements are in the same angular direction.

6. The method for grinding of claim 1, wherein said axial and radial feeding motions of said contoured grinding wheel are at least partially concurrent.

7. The method for grinding of claim 1, wherein said tip radius of said grinding wheel is substantially identical to the radius of said arc shape of said teeth.

8. The method for grinding of claim 1, wherein said generation of the individual profile of each tooth is successive and extends around an entire inner peripheral surface of said ring.

9. The method for grinding of claim 1, wherein said toothed gear wheel takes the form of an internally toothed outer ring of an IGR set that also includes an inner rotor having a plurality of external teeth.

10. The method for grinding of claim 9, wherein said predetermined speed relationship between said complex motions depends upon the relative number of teeth of said IGR inner rotor and said outer ring.

11. The method for grinding of claim 10, wherein said complex motions include both angular and orbital rotations.

12. The method for grinding of claim 11, wherein said angular and orbital rotations are in the same angular direction.

13. The method for grinding of claim 12, wherein said angular and orbital rotations are at least partially concurrent.

14. The method for grinding of claim 9, wherein said axial and radial feeding motions of said contoured grinding wheel are at least partially concurrent.

15. The method for grinding of claim 9, wherein said tip radius of said contoured grinding wheel is substantially identical to the radius of said arc shape of said teeth.

16. A method for grinding the inner peripheral surface of a ring for the successive generation of the individual profile of each tooth, of a plurality of teeth, of an internally, peripherally toothed outer ring gear of an internally generated gerotor set, said method including the steps of:

a. securing said ring on a turntable;

b. subjecting said turntable to both angular and orbital motions, in the same angular direction;

c. rotating a contoured grinding wheel, via both axial and radial feeding motions, as said grinding wheel enters into the inside of said ring, for said generation of each of said tooth profiles;

d. maintaining a tip radius of said contoured grinding wheel substantially the same as a radius of an arc shape of said teeth; and e. keeping a single contact line, between said contoured grinding wheel and said inner peripheral surface of said ring, during the actual generation of said internally toothed outer ring.

17. The method for grinding of claim 16, wherein said securing step of said ring further includes precisely positioning said ring.

18. The method for grinding of claim 16, wherein said step, subjecting said turntable to both angular and orbital motions, further includes that said motions are at least partly concurrent.

19. The method for grinding of claim 18, further including a predetermined speed relationship between said angular and orbital motions.

20. The method for grinding of claim 16, wherein said step, rotating said contoured grinding wheel, further includes that said axial and radial feeding motions of said grinding wheel are at least partially concurrent.

21. The method for grinding of claim 19, wherein said internally generated gerotor set further includes an inner rotor having a plurality of external, peripheral, teeth.

22. The method for grinding of claim 21, wherein said predetermined speed relationship between said angular and orbital motions is based upon the relative number of teeth of said inner rotor and said outer ring of said internally generated gerotor set.

23. A method for generating, at the inner peripheral surface of a ring, the individual profile of each tooth, of a plurality of teeth, of an outer ring gear of an IGR gerotor set, said method comprising:

a. precisely positioning and securing a flat side surface of said ring on a turntable;

b. imparting both angular and orbital motions, in the same angular direction and at a predetermined speed relationship, to said turntable;

c. rotating a contoured grinding wheel, for generating each said tooth profile, via both axial and radial feeding motions when said grinding wheel initially enters into the inside of said ring;

d. sustaining a tip radius of said contoured grinding wheel to be substantially the same as a radius of an arc shape of each said tooth; and e. preserving a continuous line contact, between said contoured grinding wheel and said ring inner peripheral surface, for the actual generation of said teeth for said outer ring gear.

24. The method for generating of claim 23, wherein said angular and orbital motions are fully concurrent.

25. The method of generating of claim 23, wherein said axial and radial feeding motions of said contoured grinding wheel are substantially concurrent.

* * * * *